US005833494A

United States Patent [19]

Diaz

[11] Patent Number: 5,833,494

[45] Date of Patent: Nov. 10, 1998

[54] CONNECTOR BRACKET FOR PRINTED WIRING BOARD

[75] Inventor: Randall J. Diaz, Gilroy, Calif.

[73] Assignee: Tandem Computers Incorporated, Cupertino, Calif.

[21] Appl. No.: 693,822

[22] Filed: Jul. 26, 1996

[51] Int. Cl.[6] ..... H01R 13/73

[52] U.S. Cl. ..... 439/573

[58] Field of Search ..... 361/686, 725, 361/726, 759, 801; 434/79, 80, 571, 572, 573

[56] References Cited

U.S. PATENT DOCUMENTS

| | | | |
|---|---|---|---|
| 4,193,108 | 3/1980 | Romano | 439/79 |
| 5,099,391 | 3/1992 | Maggelet et al. | 361/686 |
| 5,579,210 | 11/1996 | Ruhland et al. | 361/801 |

OTHER PUBLICATIONS

Gompf Brackets, Inc. Catalog, in existence as of May 29, 1996.

*Primary Examiner*—Neil Abrams
*Assistant Examiner*—Barry M. L. Standig
*Attorney, Agent, or Firm*—Townsend and Townsend and Crew LLP

[57] ABSTRACT

A bracket (28) secures a header (12) to a PWB (22) and includes a face plate (32) having an opening (34) sized to receive a portion (33) of the header. The face plate, and header therewith, is secured to the PWB by mounting tabs (44) secured to and extending from the face plate. Each mounting tab is relatively thin and has its narrow-width peripheral edge portion (56) adjacent to the surface (24) of the PWB. The edge portion has an opening (54) sized to accept a rivet (62) to affix the bracket to the PWB. The edge portion contacts a ground pad (66) on the PWB to provide grounding of the PWB through the bracket. The bracket includes centering tabs (48) which engage the edges (62) of the chassis openings (10) to properly position the header in the opening.

37 Claims, 2 Drawing Sheets

CONNECTOR BRACKET FOR PRINTED WIRING BOARD

BACKGROUND OF THE INVENTION

Personal computers, as well as other electronic assemblies, typically use printed wiring boards (PWBs), also called printed circuit boards, to which connectors, typically called headers, are mounted along an edge of the PWB. These printed wiring assemblies (PWAs), that is the header mounted to the PWB, are typically constructed according to industry standard called the PCI form factor. The PCI form factor regulates various design features of PWAs which are typically plugged into the chassis of the electronic assembly.

One of the problems associated with the design and construction of electronic assemblies is space. Space on the PWB is at a premium so that the method by which the header is mounted to the PWB can be limited by the amount of space available on the PWB. Also, high density connector systems, such as those using two connectors with 60 leads each, are becoming more common and aggravate the problems associated with space and can raise additional concerns related to the strength and rigidity of the mounting of the header to the PWB.

SUMMARY OF THE INVENTION

The present invention is directed to a PWB connector bracket which can be mounted to a PWB in a manner which causes minimal surface area of the PWB to be covered, which provides enhanced electrical grounding contact between the bracket and the PWB, and which increases the strength of the mounting of the header to the PWB. The invention also helps to properly position the header within the header opening formed in the chassis.

The bracket includes a face plate having an opening formed through the face plate sized to receive a portion of the header. The header is secured to the face plate. The bracket also includes at least one, and preferably two, mounting tabs secured to and extending from the face plate. The bracket and header therewith are secured to the PWB by the mounting tab. The mounting tab is relatively thin and has its narrow-width peripheral edge oriented adjacent to the surface of the printed wiring board. The printed wiring board has an opening to accept a fastener, such as a rivet. The fastener and the mounting tab are configured so that the fastener securely affixes the bracket and connector therewith to the printed wiring board.

The mounting tab preferably contacts a ground trace or pad on the printed wiring board to provide grounding of the printed wiring board through the bracket and to the chassis. The chassis includes a header opening sized to receive a portion of the connector passing through the opening in the face plate of the bracket. The bracket preferably includes two or more centering tabs which engage the edges of the header opening. The centering tabs ensure that the header is completely available to receive its mating cable assembly.

An advantage of the invention is that it permits the use of low cost fasteners and high speed production tools to mount the bracket to the PWB. Using rivets to secure the bracket to the PWB can reduce the overall fastener count, can reduce assembly time and thus can reduce overall product cost. It has been found that using rivets to secure the bracket to the PWA provides a secure, rigid mounting for the header while also providing an excellent electrical contact between the bracket and a ground pad or trace on the PWB.

The unique geometry of the mounting tab covers very little surface area of the PWB, a very important consideration because of the small amount of space typically available on the dual high density connector PCI form factor PWB. A further advantage of the invention is that the rivet or other fastener used to engage the fastener opening formed in the mounting tab can be passed through an existing conventional tooling hole provided pursuant to PCI specifications. The invention provides a reliable way of establishing a high quality ground path without the requirement of any extra mounting holes, mounting elements, or excessive bracket footprint area (which tends to, when used for grounding, create excessive, uneven solder build-up, skewing the mounting surface) on the PWB.

Another advantage of the invention is the provision of locating or centering tabs carried by the bracket. The locating tabs typically engage the edge of the header opening formed in the chassis to ensure proper alignment of the header within the chassis header opening. Doing so helps to ensure the full and proper seating of cable plugs, thus increasing the reliability of the assembly.

Other features and advantages of the invention will appear from the following description in which the preferred embodiment has been set forth in detail in conjunction with the company drawings.

DESCRIPTION OF THE PREFERRED EMBODIMENT

Figure 1:
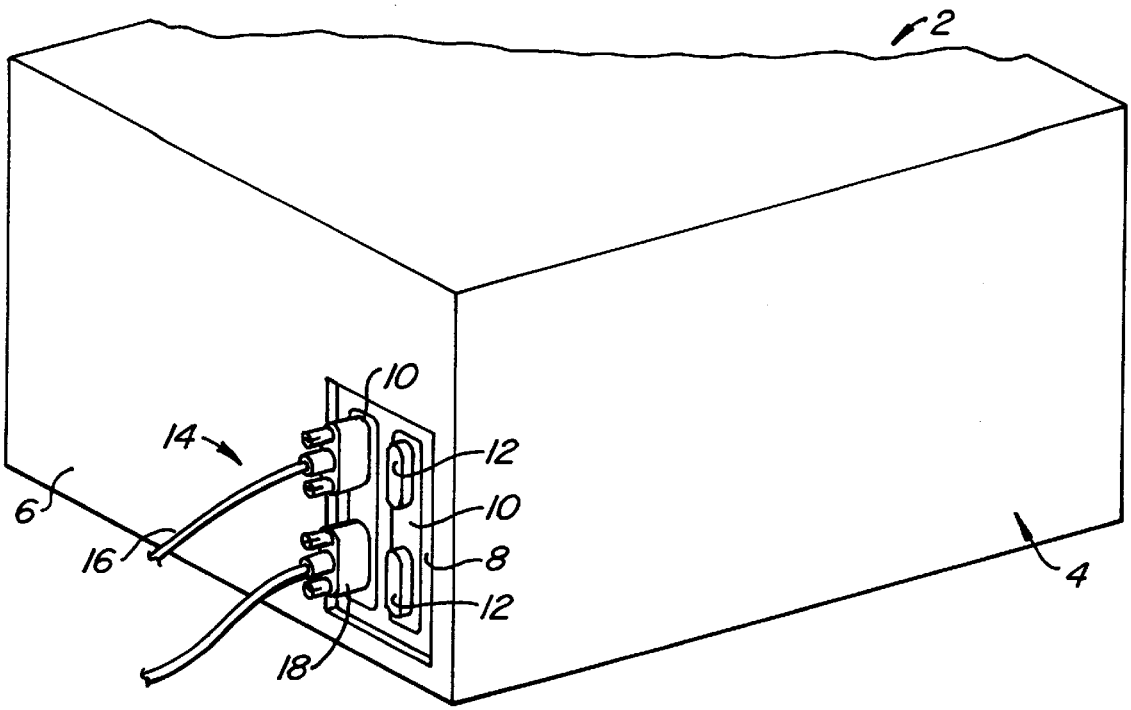
FIG. 1 is a simplified overall view of the personal computer illustrating a pair of cable assemblies extending from the back of the computer.

FIG. 1 illustrates a personal computer (PC) 2 and includes a chassis 4 which has a back 6. Back 6 has a recessed wall 8 defining a number of chassis header openings 10 which provide access to connectors 12, typically called headers, by cable assemblies 14. Cable assemblies 14 include cables 16 and cable plugs 18, the cable plugs securable to headers 12 in a conventional manner. PC 2 could be an electronic assembly other than a personal computer, such as a router hub or an I/O board.

Figure 2:
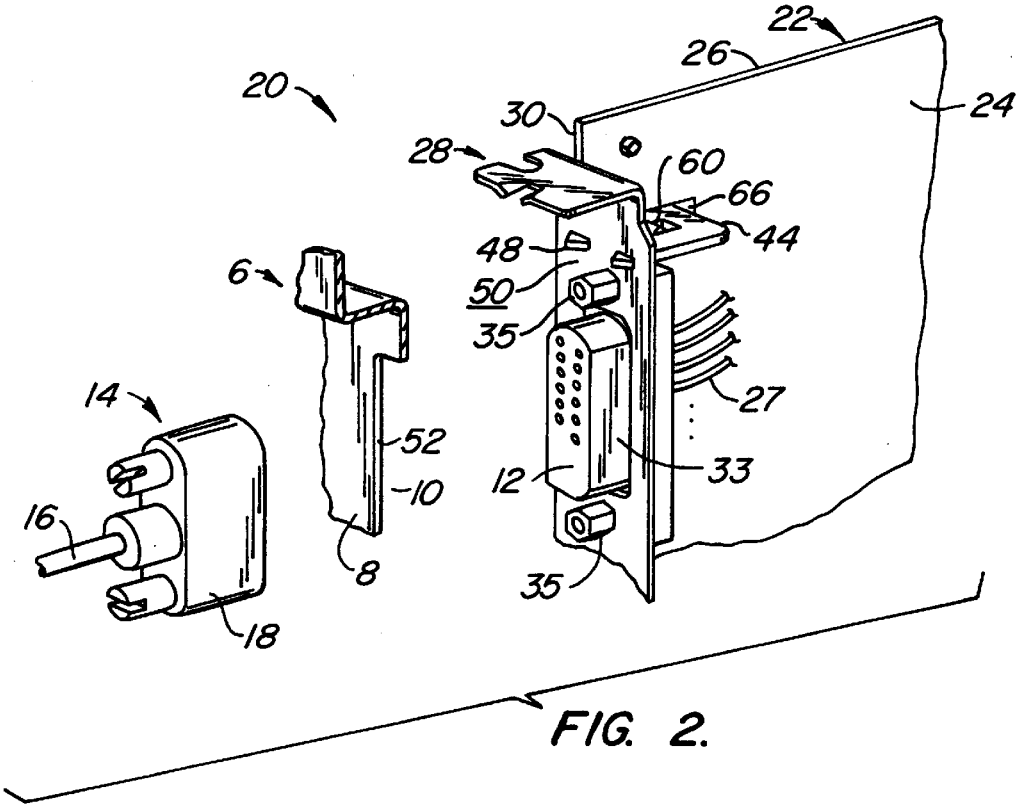
FIG. 2 is a partially exploded isometric view of portions of the cable assembly, chassis, and printed wire assembly made according to the invention.
Figure 3:
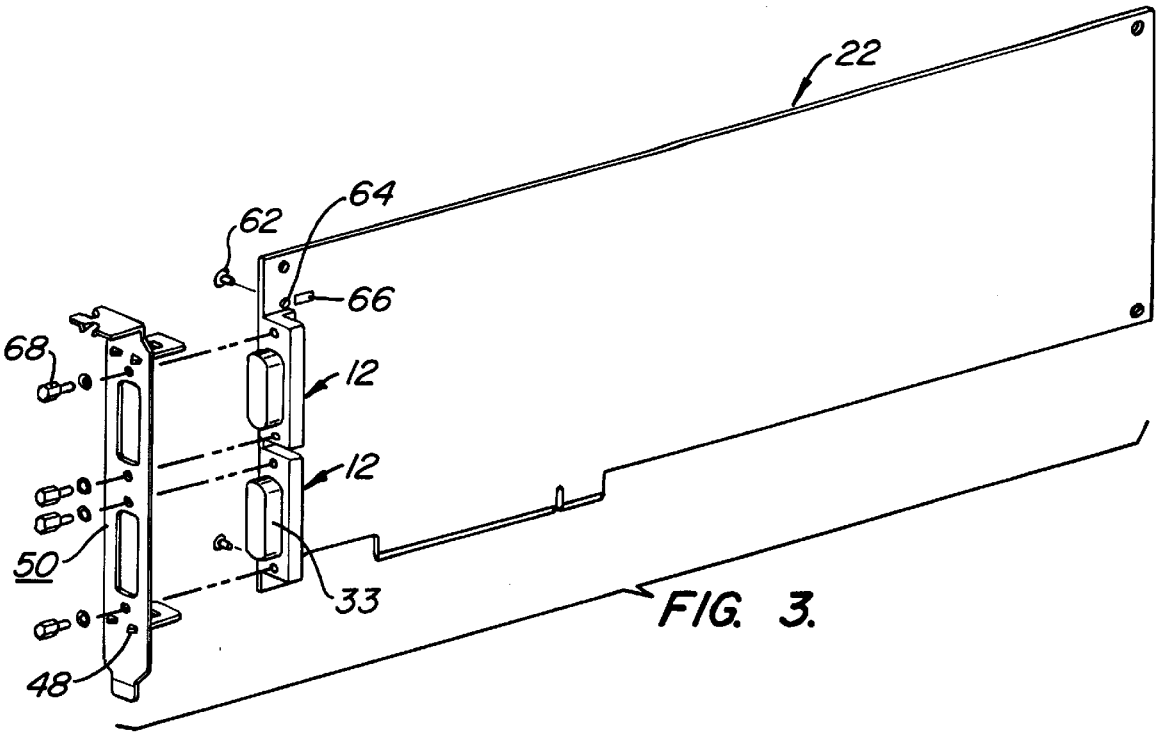
FIG. 3 is an exploded isometric view of the printed wire assembly of FIG. 2.
Figure 4:
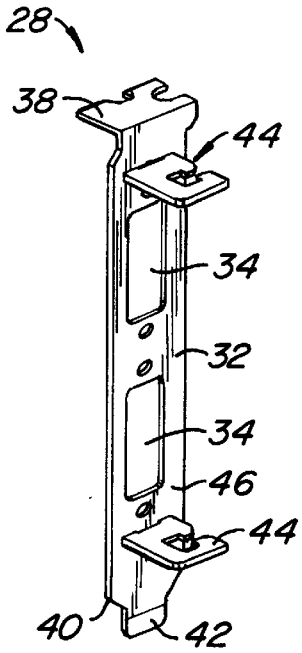
FIG. 4 is an enlarged isometric view of the reverse side of the bracket of FIG. 3.

FIG. 2 illustrates the relative arrangement of cable assembly 14, recessed chassis wall 8 and a printed wire assembly (PWA) 20, of which header 12 is a part. Printed wire assembly 20 also includes a printed wire board (PWB) 22 mounted upright within PC 2. PWB 22 has a first face 24 bounded by a peripheral edge 26. PWA 20 is preferably designed according to the PCI (peripheral components interconnect) form factor, which is a standard form factor for cards plugged into PC boards. Header 12 is secured to first face 24 of PWB 22 by soldering the leads 27 of the header to the PWB. In addition, a bracket 28, see FIGS. 3 and 4, is used to further secure header 12 to first face 24 of PWB 22 adjacent to forward or connector edge 30 of peripheral edge 26. The use of bracket 28 provides protection for the soldered leads 27.

Bracket 28 includes a generally flat face plate 32 defining a pair of face plate header openings 34. Outwardly extending connector portions 33 of headers 12 are each secured within openings 34 by jackscrew fasteners 35. Face plate 32 is about 112 mm long, 18.4 mm wide and 0.86 mm thick. The upper end 36 of face plate 32 has a conventional right angle PCI form factor 38 while the lower end 40 has a conventional form factor 42, form factor 42 being a slightly angled tab. Upper and lower form factors 38 and 42 are conventional and engage parts of chassis 4 in a conventional manner and thus will not be described further.

Bracket 28 also includes a pair of mounting tabs 44 extending at right angles from the inner face 46 of face plate 32. Bracket 28 is preferably made from zinc-plated cold rolled steel. Each mounting tab 46 has the width of about 12.5 mm, a length of about 15 mm and thickness of about 1.2 mm. The thickness of mounting tab 44 is about 9% to 13% of the shorter of the width and length of the mounting tab; in this preferred embodiment this value is about 10%.

Mounting tabs 44 each include two tapered extensions 48 which pass through openings in face plate 32 and extend outwardly from the outer face 50 of the face plate. Mounting tabs 44 are welded to face plate 46 at extensions 48. Tapered extensions 48 act as centering or locating tabs by engaging the peripheral edge 52 defining chassis header opening 10 as will be discussed in more detail below.

Figure 5:
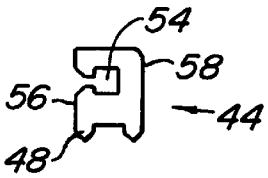
FIG. 5 is a top plan view of the mounting tab of FIG. 4.

Each mounting tab 44 also includes a generally T-shaped slot or opening 54, see FIG. 5, extending inwardly from a PWB-facing portion 56 of the periphery 58 of mounting tabs 44. Opening 54 is sized to accept an enlarged or mushroomed head 60 of a rivet 62. See FIG. 2. Rivet 62 passes through a hole 64 formed in PWB 22. Hole 64 is preferably a standard tooling hole which already exists in PWB 22 as prescribed by PCI specifications. PWB 22 also includes a ground pad or contact 66 positioned adjacent to hole 64 for contact with portion 56 of periphery 58. Good electrical contact between tab 44 and ground pad 66 is assured by the use of rivets 62.

It is preferred that the average lateral dimension of rivet 62, or some other fastener, be about the thickness of mounting tab 44. While it is possible to replace rivet 62 with a different type of fastener, such as a threaded fastener, rivet 62 has been shown to work extremely well providing a highly reliable, strong fastener for this edge-on orientation of mounting tab 44.

The construction and orientation of mounting tabs 44 create an effective mount for securing headers 12 to PWB 22 through bracket 28. Mounting tabs 44 accomplish this with a very small footprint. That is, the surface area of portion 56 of periphery 58 is very small since mounting tab 44 is mounted to first face 24 of PWB 22 on its edge rather than on a face as would be conventional.

It is important that header 12 be centered within chassis header opening 10 to ensure the proper mating of cable plug 18 with header 12. To help ensure this, locating tabs 48 are positioned to engage peripheral edge 52 defining chassis header opening 10. This ensures the proper lateral positioning of header 12 within opening 10 for proper mating of cable plug 18 with header 12.

In use, headers 12 are secured to PWB 22 by soldering and bracket 28 is mounted to headers 12 using fasteners 35. Bracket 28 is secured directly to first face 24 of PWB 22 using rivets 62 passing through holes 64, the enlarged head 60 of each rivet 62 expanding within T-slot 54 pulling portion 56 of periphery 58 against ground pad 60. Mounting PWA 20 within chassis 4 is carried out by passing connector portion 33 of header 12 through chassis header opening 10, this movement being guided by centering tabs 48. Once properly secured within chassis 4, PWA 20 is available for cable assembly 14 to engage headers 12 as shown in FIG. 1.

Modification and variation can be made to the disclosed embodiment without departing from the subject of the invention as defined by the following claims. For example, bracket 28 can be made to accommodate more or less than two headers 12. Tapered extensions 48 need not be made as extensions of mounting tabs 44. T-slot 54 could be replaced by a threaded opening; such a threaded opening could be completely enclosed along its length or it could have lateral openings or gaps. Other types of fasteners which employ the small footprint of portion 56 of periphery 58 can also be used so long as they create enough tension to create a tight, specifically a gas-tight, connection between tabs 44 and PWB 22.

What is claimed is:

1. A bracket for securing a connector to a printed wiring board (PWB) comprising:

a face plate having first and second faces and a face plate connector opening formed through the first and second faces;

a mounting tab secured to the face plate and extending from the first face;

the mounting tab comprising first and second surfaces defining a thickness therebetween and bounded by a peripheral edge, said peripheral edge comprising a PWB-facing edge portion, said mounting tab defining a fastener opening extending from the PWB-facing edge portion;

said fastener opening having an inlet portion at said PWB-facing edge portion and an enlarged main portion spaced apart from said PWB-facing edge portion; and said first and second surfaces having first and second orthogonal dimensions, said thickness being substantially less than either of the first and second orthogonal dimensions.

2. The bracket according to claim 1 wherein the face plate comprises a plurality of said face plate connector openings.

3. The bracket according to claim 1 wherein the mounting tab is generally flat.

4. The bracket according to claim 1 wherein the mounting tab is perpendicular to the first face.

5. The bracket according to claim 1 wherein the peripheral edge is rectangular.

6. The bracket according to claim 1 wherein the fastener opening extends through said first and second surfaces.

7. The bracket according to claim 1 wherein said fastener opening is generally T-shaped.

8. The bracket according to claim 1 wherein said mounting tab is made of metal.

9. The bracket according to claim 1 further comprising a locating tab extending from the second face of the face plate.

10. The bracket according to claim 9 wherein said locating tab has a tapered surface.

11. The bracket according to claim 9 wherein said locating tab is an extension of said mounting tab.

12. The bracket according to claim 1 wherein said mounting tab is welded to said face plate.

13. The bracket according to claim 1 wherein said mounting tab comprises an electrical conduction path from said PWB-facing portion of said peripheral edge to said face plate.

14. The bracket according to claim 13 wherein said bracket is made of an electrical conductor.

15. The bracket according to claim 14 wherein said bracket is made of metal.

16. The bracket according to claim 1 wherein the thickness is at most about 9% to 13% of the shorter of said first and second orthogonal dimensions.

17. A printed wiring assembly comprising:

a printed wiring board (PWB) comprising first and second PWB faces and a connector edge;

a bracket for securing the connector to the PWB adjacent to the connector edge, the bracket comprising:

a face plate having first and second faces and a face plate connector opening formed through the first and second faces;

a mounting tab secured to the face plate and extending from the first face;

the mounting tab comprising first and second surfaces defining a thickness therebetween and bounded by a peripheral edge, said peripheral edge comprising a PWB-facing edge portion, said mounting tab defining a fastener opening extending from the PWB-facing edge portion;

said fastener opening having an inlet portion at said PWB-facing edge portion and an enlarged main portion spaced apart from said PWB-facing edge portion; and said first and second surfaces having first and second orthogonal dimensions, said thickness being substantially less than either of the first and second orthogonal dimensions;

a connector, having a portion passing through the face plate connector opening, secured to the face plate; and a fastener extending from the first PWB face and engaging the fastener opening of the mounting tab to affix the bracket and connector therewith to the PWB.

18. The assembly according to claim 17 wherein: the face plate comprises a plurality of said face plate connector openings;

the mounting tab is generally flat;

the mounting tab is perpendicular to the first face; and the peripheral edge is rectangular.

19. The assembly according to claim 17 wherein the fastener opening is generally T-shaped and extends through said first and second surfaces.

20. The assembly according to claim 17 further comprising a locating tab extending from the second face of the face plate, said locating tab being an extension of said mounting tab and said mounting tab being welded to said face plate, said locating tab having a tapered surface.

21. The assembly according to claim 17 wherein said bracket is made of an electrical conductor and said mounting tab comprises an electrical conduction path from said PWB-facing portion of said peripheral edge to said face plate.

22. The assembly according to claim 17 wherein said PWB comprises a ground trace in electrical contact with said PWB-facing portion.

23. The assembly according to claim 17 wherein the fastener comprises a rivet.

24. The assembly according to claim 23 comprising a plurality of said mounting tabs and said rivets.

25. The assembly according to claim 17 wherein the fastener has a transverse dimension about equal to the thickness.

26. The assembly according to claim 17 wherein the thickness is at most about 9% to 13% of the shorter of said first and second orthogonal dimensions.

27. An electronic assembly comprising:

a printed wiring assembly (PWA) comprising:

a printed wiring board (PWB) comprising first and second PWB faces and a connector edge;

a bracket for securing the connector to the PWB adjacent to the connector edge, the bracket comprising:

a face plate having first and second faces and a face plate connector opening formed through the first and second faces;

a mounting tab secured to the face plate and extending from the first face;

the mounting tab comprising first and second surfaces defining a thickness therebetween and bounded by a peripheral edge, said peripheral edge comprising a PWB-facing edge portion, said mounting tab defining a fastener opening extending from the PWB-facing edge portion;

said fastener opening having an inlet portion at said PWB-facing edge portion and an enlarged main portion spaced apart from said PWB-facing edge portion; and said first and second surfaces having first and second orthogonal dimensions, said thickness being substantially less than either of the first and second orthogonal dimensions;

a connector, having a portion passing through the face plate connector opening, secured to the face plate; and a fastener extending from the first PWB face and engaging the fastener opening of the mounting tab to affix the bracket and connector therewith to the PWB; and a chassis housing the PWA, the chassis comprising a wall defining a chassis connector opening sized and positioned to accept said portion of said connector.

28. The assembly according to claim 27 wherein:

the face plate comprises a plurality of said face plate connector openings;

the mounting tab is generally flat;

the mounting tab is perpendicular to the first face; and the peripheral edge is rectangular.

29. The assembly according to claim 27 wherein the fastener opening is generally T-shaped and extends through said first and second surfaces.

30. The assembly according to claim 27 further comprising a locating tab extending from the second face of the face plate, said locating tab being an extension of said mounting tab and said mounting tab being welded to said face plate, said locating tab having a tapered surface.

31. The assembly according to claim 27 wherein said bracket is made of an electrical conductor and said mounting tab comprises an electrical conduction path from said PWB-facing portion of said peripheral edge to said face plate.

32. The assembly according to claim 27 wherein said PWB comprises a ground trace in electrical contact with said PWB-facing portion.

33. The assembly according to claim 27 wherein the fastener comprises a rivet.

34. The assembly according to claim 33 comprising a plurality of said mounting tabs and said rivets.

35. The assembly according to claim 27 wherein the fastener has a transverse dimension about equal to the thickness.

36. The assembly according to claim 27 wherein the thickness is at most about 9% to 13% of the shorter of said first and second orthogonal dimensions.

37. A bracket for securing a connector to a printed wiring board (PWB) comprising:

a face plate having first and second faces, a face plate connector opening formed through the first and second faces, and a form factor tab extending from said second face at one end;

a mounting tab secured to the face plate and extending from the first face in a direction opposite said form factor tab and generally parallel to said form factor tab;

the mounting tab comprising first and second surfaces defining a thickness therebetween and bounded by a peripheral edge, said peripheral edge comprising a PWB-facing edge portion, said mounting tab defining a fastener opening extending from the PWB-facing edge portion; and said first and second surfaces having first and second orthogonal dimensions, said thickness being substantially less than either of the first and second orthogonal dimensions.

* * * * *